US010905291B2

(12) United States Patent
Bürgelin et al.

(10) Patent No.: US 10,905,291 B2
(45) Date of Patent: Feb. 2, 2021

(54) WASHING DEVICE

(71) Applicant: New Flag GmbH, Munich (DE)

(72) Inventors: Stefan Bürgelin, Mühlheim-Britzingen (DE); Daniel Krämer, Neuenburg am Rhein (DE); Andreas Martin, Neuenburg am Rhein (DE)

(73) Assignee: New Flag GmbH, München (DE)

( * ) Notice: Subject to any disclaimer, the term of this patent is extended or adjusted under 35 U.S.C. 154(b) by 0 days.

(21) Appl. No.: 16/436,155

(22) Filed: Jun. 10, 2019

(65) Prior Publication Data

US 2019/0290077 A1 Sep. 26, 2019

Related U.S. Application Data

(63) Continuation of application No. 15/254,287, filed on Sep. 1, 2016.

(30) Foreign Application Priority Data

Sep. 1, 2015 (DE) ..... 10 2015 011 165

(51) Int. Cl.

| | |
|---|---|
| ***A47K 7/03*** | (2006.01) |
| ***A47K 7/02*** | (2006.01) |
| ***A47L 13/17*** | (2006.01) |

(52) U.S. Cl.

CPC ..... *A47K 7/03* (2013.01); *A47K 7/02* (2013.01); *A47L 13/17* (2013.01)

(58) Field of Classification Search

CPC .. A47K 7/03; A47K 7/02; A47K 7/022; A47L 13/16; A47L 13/17; C11D 7/50; C11D 9/48; C11D 10/04; C11D 10/042

USPC ..... 401/196, 201

See application file for complete search history.

(56) References Cited

U.S. PATENT DOCUMENTS

| | | | | |
|---|---|---|---|---|
| 3,791,746 A * | 2/1974 | Yearka | A47K 7/022 401/201 |
| 5,691,287 A * | 11/1997 | Villars | C11D 1/83 510/130 |
| 6,852,681 B1 * | 2/2005 | Kerschner | C11D 17/0073 510/152 |
| 9,333,157 B2 * | 5/2016 | Jiang | A61K 8/58 |
| 10,342,392 B2 * | 7/2019 | Burgelin | A47K 7/02 |

* cited by examiner

*Primary Examiner* — David J Walczak
(74) *Attorney, Agent, or Firm* — McGlew and Tuttle, P.C.

(57) ABSTRACT

In a washing element holder (2), which on one side is closed off relative to the outside (s) with a sponge material (5) having pores (4), a washing device (1) has a washing element (3) which has at least one synthetic surfactant as a foaming substance and the principal constituent.

1 Claim, 3 Drawing Sheets

WASHING DEVICE

CROSS REFERENCE TO RELATED APPLICATIONS

This application is a continuation under 37 CFR 1.53(b) of pending prior U.S. patent application Ser. No. 15/254,287 filed Sep. 1, 2016, now U.S. Pat. No. 10,342,392, which claims the priority of German Application DE 10 2015 011 165.5 filed Sep. 1, 2015, the entire contents of each application are incorporated herein by reference.

FIELD OF THE INVENTION

The invention relates to a washing device with a washing element holder which is preferably closed off relative to the outside and with a washing element which is inserted into the washing element holder, wherein on at least one side the washing element holder is closed off relative to the outside with a sponge material having pores.

BACKGROUND OF THE INVENTION

Such washing devices are known in various embodiments and are used for body cleansing for example. The purpose of these washing devices is that at the same time as the mechanical cleansing process in which the washing device is rubbed over a part of the body, an active washing substance is imparted onto the body, preferably with the formation of foam.

SUMMARY OF THE INVENTION

An object of the invention is to improve the functional characteristics of the washing devices of the type set out in the introduction and previously known from the prior art.

According to the invention, a washing device comprises a washing element holder which is preferably closed off relative to an outside and comprising a washing element which is inserted into the washing element holder. On at least one side the washing element holder is closed off relative to the outside with a sponge material which has pores. The washing element contains at least one synthetic surfactant as a foaming substance and as the principal constituent. It has been determined that in the case of washing products which contain at least one synthetic surfactant as a foaming substance and as the principal constituent, foaming already occurs through the washing element simply coming into contact with water and air, without friction being required for creating the foam.

In contrast to this, in the case of generally used soaps, foaming up of the soap has to be brought about through friction between the soap and a surface, for example a part of the body to be cleaned or a sponge or a flannel. However, this can have disadvantages as it is relatively difficult to initiate the foaming up of a soap.

Using the washing device according to the invention now has the advantage that simply the penetration of water through the pores of the sponge material and the contacting between the washing element and water and air associated therewith are sufficient for producing the pleasant foam for cleansing the body. This foam, which is thus produced within the washing device in the washing element holder, can be conveyed outwards through the pores of the sponge material, through which the water and air has previously penetrated into the washing element holder, and is then available for washing or cleansing.

If the washing element in enclosed in its usage position within the washing element holder so that it cannot be lost, it cannot then fall out of the washing device as it reduces in volume during the course of utilization of the washing device and increasing consumption of the washing element. Replacement of the washing element can also be prevented in this way.

It is particularly preferable if at least 50%, preferably at least 80%, particularly preferably at least 95% of the washing element is made up of the at least one synthetic surfactant. If the washing element consists only of the at least one synthetic surfactant or only of synthetic surfactants it can also be designated as a syndet.

In a washing device according to the invention which is suitable for particularly gentle cleansing of the skin, the washing element can be soap-free. Soap-free cleansing is especially preferable for persons with sensitive skin. Soap-free can, for example, be characterized in that no alkaline salts of carboxylic acids are present.

It is also possible for the washing element to be in the form of a combar. Combars are washing products which contain both soap and syndet portions.

It is possible to create a washing device in which the washing element of the washing device according to the invention also contains a soap portion with a soap in addition to a syndet portion.

The syndet portion and soap portion can also be inextricably mixed with each other. In this way a homogeneous distribution of the syndet portion in the washing element can be achieved.

In one form of embodiment of the invention it can be envisaged that before use of the washing device the pores of the sponge material are essentially, e.g. in relation to a total length of a pore or the pores, or completely free of surfactants.

To ventilate or moisten the washing element from outside it is advantageous if the pores are permeable to air and/or water. In this way it is possible for the quantity of water and air necessary for wetting the washing element and for foaming up of the substances forming the washing element to reach the washing element through the pores. It is thus also possible for the foam formed in the washing element holder to emerge via the pores.

In an advantageous form of embodiment of the washing device the washing element can be surrounded on all sides by sponge material.

It is also possible for the washing device to comprise two halves which can be connected to each other and surround the washing element and/or washing element holder in the connected usage position. In this case one of the halves, or both halves can at least in parts be formed of the sponge material.

It can also be practicable if, when in use, one half of the washing device has a recess on its side facing the other half which forms the washing element holder into which the washing element can be inserted in the usage position.

However it is also possible for both halves of the washing device to each have a recess on their side facing the other half when in usage position. In the connected usage position both of these recesses can then jointly form the washing element holder into which the washing element can be inserted. This makes tension-free connection of both halves possible, wherein the one connection point between the two halves is only under slight or no strain at all. This can benefit the durability of the connection and prolong the duration of use of the washing device.

To connect the two halves of the washing device it can be envisaged that the two halves of the washing device are adhered to one another, particularly after insertion of the washing element into the washing element holder. It can be of particular advantage if this takes place with a non-hazardous adhesive Non-hazardous adhesives or glues are adhesives or glues which on the basis of their composition are harmless to health and are therefore freely available. Such adhesives or glues are particularly suitable for use in the washing device according to the invention as they can come into contact with the skin during normal use and could thus be classified as cosmetic products. In this way washing devices according to the invention can be provided that are also suitable for use in the case of small children and babies, who, as experience has shown, have more sensitive skin than adults.

It can also be an advantage if the washing element is prefabricated, more particularly pre-stamped, in a format suitable for inserting into the washing element holder. Above all, stamping of the washing element from a blank can be seen as a particularly simple and therefore rational method of production. In comparison with the washing devices previously known from the prior art, in which the active washing substance is injected or pushed into a hollow space and/or into pores of the sponge material of these devices, in the case of the washing device according to the invention the washing element can be inserted into the washing element holder in its pre-stamped format. This results in the major improvement that the solid shape of the washing element can led to a considerably longer service durability of the washing element and therefore also of the washing device itself, as due to the stamped shape the surface is smaller and the water therefore reacts on a smaller surface area at the same time as the washing element. In contrast, when injecting active washing substances into pores no uniform washing element shape would be formed and the water would react at all points simultaneously and thus lead to the active washing substances and/or the washing element being used up very quickly.

Particularly if the washing device has two halves which adhere fully to each other at their contact surfaces there is no possibility of replenishing the washing device with a washing element containing syndet once the washing element inserted during the production of the washing device has been used up.

If the washing element has a smooth surface it is on the one hand possible to release a quantity of synthetic surfactant sufficient for a good effect of the washing device from the surface of the washing element through moistening or rinsing around the surface of the washing element, and on the other hand to limit the quantity of synthetic surfactant released and thereby achieve an adequate duration of use of the washing device within which active washing substance can be released while forming foam.

The washing device can be particularly suitable for use in the case of sensitive persons and/or persons with allergies if the at least one synthetic surfactant is disodium lauryl sulfosuccinate. The washing element can also contain anionic and/or cationic substances, for example sulfoacetate, in particular disodium laureth sulfosuccinate For convenience of use and also storage of the washing device according to the invention, it can have at least one device for hanging up. This hanging device can, in particular, be in the form of a cord, hook, eye and/or loop.

The sponge material of the washing device can comprise synthetic sponge, foam and/or natural sponge. A mixture of the aforementioned materials is of course also conceivable. The sponge material can be stamped or cut to any form in order to give the washing device any desired shape. In this way the washing device, and in particular the sponge material of the washing device can, for example, take on the shape of an animal or any other imaginary shape.

Suitable synthetic sponges or foams are, for example, foams of polyethylene (PE), polyolefin (PO), so-called hydro-foam, ether foams and/or ester foams.

Various variants of the washing device according to the invention are conceivable. Thus, in one washing device it can be envisaged that the washing device, in particular one half of the washing device has a grip or a glove and/or a cloth and/or and towel and/or a washing brush and/or is arranged or formed on a washing brush.

In a particularly advantageous effective manner the washing device according to the invention can thus be combined with another function contributing to effective cleaning.

It is also possible for the washing element to contain at least one active washing substance which contains no surfactants. Such active washing substances can for example be polishing agents and/or a solid rinsing agent.

Examples of embodiment of the invention are described in more detail below with the aid of the drawing.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
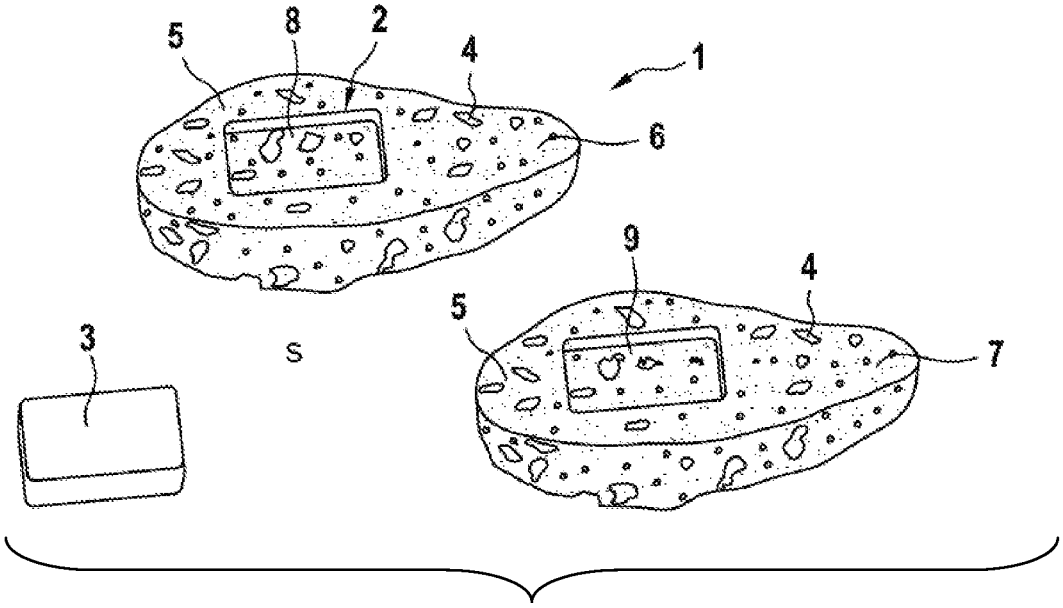
FIG. 1 is a perspective view of the components of a washing device according to the invention, wherein two halves of the washing device and a washing element can be seen.
Figure 2:
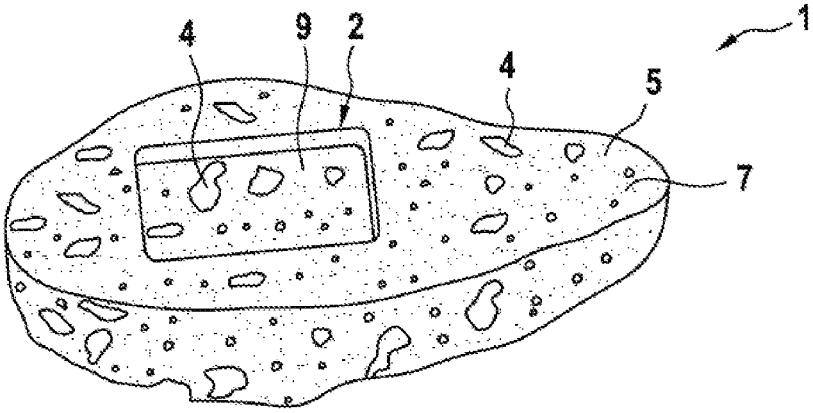
FIG. 2 is one of the two halves of the washing device according to the invention shown in FIG. 1, wherein a recess which is inserted in the foam material of the half and forms a part of the washing element holder can be seen.

Referring to the drawings, FIGS. 1 to 7 show a washing device, designated 1 in its entirety, and/or components of a washing device 1. All washing devices 1 have a washing element holder 2 and a washing element 3 inserted into the washing element holder 2. In the usage position, each of the washing element holders 2 shown in the figures is closed off relative to the outside s on at least one side with sponge material 5 having pores 4.

Figure 3:
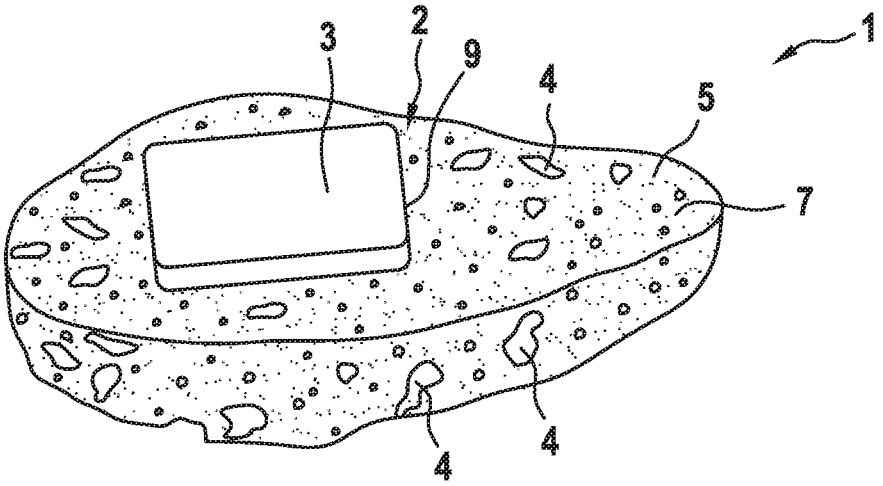
FIG. 3 is one of the two halves of the washing device shown in FIGS. 1 and 2, wherein the washing element shown in FIG. 1 is shown inserted into the recess of the half forming part of the washing element holder.
Figure 4:
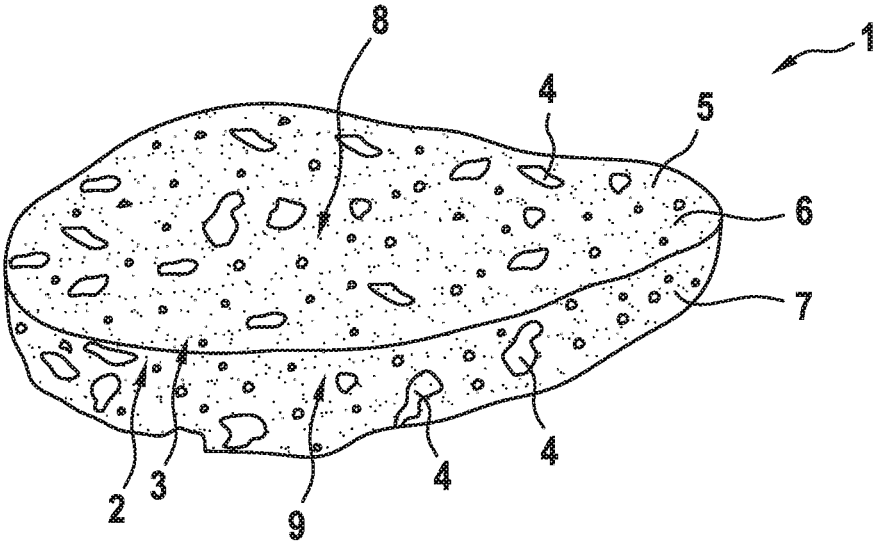
FIG. 4 is a form of embodiment of the washing device according to the invention composed of the components of the washing device shown in FIGS. 1 to 3.

The washing element 3, shown for example in FIGS. 1 and 3, which is inserted into the washing element holder 2 in the usage position contains at least one active washing substance, which can also designated as a detergent.

The washing element 3 contains at least one synthetic surfactant as a foaming substance and as the principal constituent.

In one form of embodiment of the washing element 3 it is envisaged that at least 50% thereof consists of the at least one synthetic surfactant. In other forms of embodiment of the washing device according to the invention at least 80% or at least 95%, or even almost or precisely 100%, so that a syndet is formed, of the washing element 3 consists of the at least one synthetic surfactant.

In a preferred form of embodiment of the washing device 1 the washing element is soap-free, i.e. it contains no soap but only a syndet or only synthetic surfactants as the active washing substance.

In one form of embodiment of embodiment of the invention which is not shown in the figures, it is envisaged that the washing element 3 is in the form of a so-called combar and in addition to a syndet portion with the at least one synthetic surfactant also has a soap portion with a soap. The syndet portion and the soap portion can be inextricably mixed with each other and thus form a microscopically homogeneous washing element 3.

In the washing device 1 shown in the figures, it is envisaged that before use of the washing device 1, in particular before the washing device 1 is used for the first time, the pores 4 are essentially free of surfactants, wherein, for example pore ends can be filled with synthetic surfactant. It is also possible for the pores 4 to be completely free of surfactants before use of the washing device 1, in particular before the washing device 1 is used for the first time.

The pores 4 of the washing device 1 are permeable to air and water so that the washing element 3 arranged in the washing element holder 2 in the usage position can be well ventilated and moistened. For this the pores 4 connect the washing element holder 2 with the surroundings of the washing device 1. This benefits the foam formation, which in the case of a syndet can only occur though contact with air and water, for the special washing experience when using the washing device 1 according to the invention.

Relative friction between the washing element 3 and the sponge material 5 or another surface of the washing device 1 is not necessary for bringing about foaming of the synthetic surfactant.

In the form of embodiment of the washing device 1 shown in FIGS. 1 to 4 the washing element 3 is surrounded by sponge material 5 on all sides. In this way, foam produced through moistening of the washing element 3 can emerge through all pores 4 of the sponge material 5 surrounding the washing element 3 on all sides.

FIGS. 1 to 4 also show that the washing device 1 comprises two halves 6 and 7 which can be connected to each other and surround the washing element 3 and also the washing element holder 2 when in the connected usage position. In the example of embodiment of the washing device 1 according to the invention shown in FIGS. 1 to 4, the two halves 6 and 7 consist of the sponge material 5.

Both halves 6 and 7 of the washing device 1 each have a recess 8, 9 forming the washing element holder 2 on their side facing the other half 6, 7 in the usage position. In the connected usage position both recesses 8, 9 of the two halves 6, 7 of the washing device 1 jointly form the washing element holder 2 into which the washing element 3 can be inserted in the usage position.

In their connected usage position according to claim 4 the two halves 6, 7 are shown connected to each other. Preferably the two halves 6, 7 can be adhered to each other with a non-hazardous adhesive so that the washing device 1 is also particularly suitable for sensitive persons, for example small children or babies.

The washing element 3 of the washing device 1 is prefabricated in a format suitable for inserting into the washing element holder 2. One possibility of prefabricating the washing element 3 with a suitable format is to stamp the washing element 3 out of a blank.

The washing element 3 shown in FIGS. 1 and 3 has a smooth surface through which uniform and controlled release of active washing substance from the washing element 3 can be achieved when the washing element 3 comes into contact with water and air.

The washing element 3 can contain a mixture of several synthetic surfactants. The use of disodium lauryl sulfosuccinates has proven to be particularly advantageous.

Figure 6:
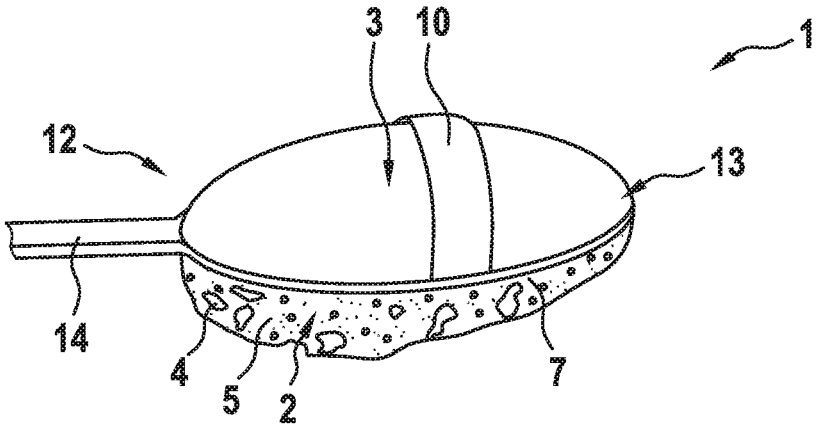
FIG. 6 is a perspective view showing a further example of embodiment of a washing device according to the invention which is designed in the form of a washing brush.

On one side the form of embodiment of the washing device 1 according to FIG. 6 has a hanging device 10. In this case this is designed as a loop or tape. However, it is also possible that all the washing devices 1 shown in the figures and described in the text have such a hanging device 10 and/or additionally or alternatively thereto a cord, a hook or an eye or similar as a hanging device 10.

The sponge material 5 of the washing device 1 can comprise synthetic sponge, foam and/or natural sponge. A mixture of the aforementioned sponge materials is of course also conceivable.

Figure 5:
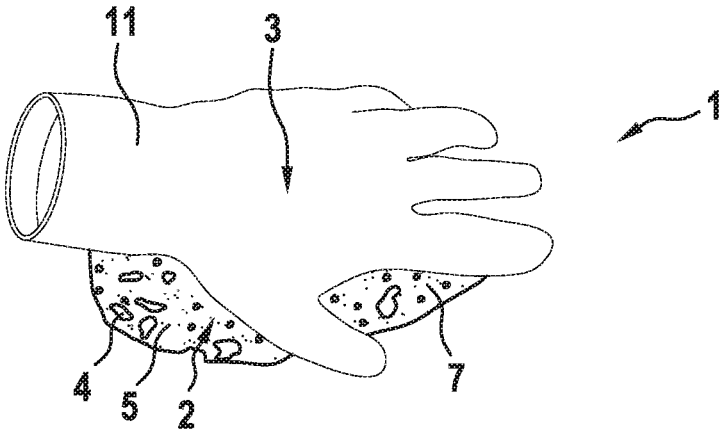
FIG. 5 is a further perspective view of washing device according to the invention which on one of its sides has a glove for a user.
Figure 7:
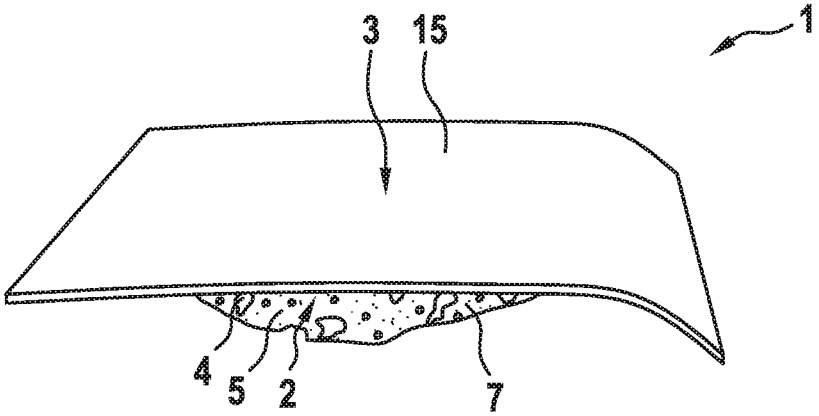
FIG. 7 is a perspective view showing a further washing device according to the invention which on one side has a cloth, more particularly a towel.

FIGS. 5 to 7 show further expedient forms of embodiment of the washing device 1.

FIG. 5 shows a form of embodiment of the washing device 1 in which on one half 6, 7 of the washing device 1 a glove 11 is applied and/or formed for use of the washing device 1.

FIG. 6 shows a form of embodiment of the washing device 1 according to the invention in which on one half 6, 7 of the washing device 1 a brush element of a washing brush 12 is applied and/or formed. Arranged on the brush head 13 of the washing brush 12, the washing brush 12 has a handle 14 on which the washing device can be held.

FIG. 7 finally shows a fourth form of embodiment of the washing device 1 in which one side of the washing device 1 is provided with a cloth 15 which can, for example, be used as or is designed as a towel.

In a washing element holder 2, which on one side is closed off relative to s the outside with a sponge material 5 having pores 4, a washing device 1 comprises a washing element 3 which contains at least one synthetic surfactant as a foaming substance and the principal constituent.

While specific embodiments of the invention have been shown and described in detail to illustrate the application of the principles of the invention, it will be understood that the invention may be embodied otherwise without departing from such principles.

What is claimed is:

1. A washing device comprising:

a washing element holder at least partially closed to an outside, the washing element holder comprising a sponge material having pores; and a washing element inserted into the washing element holder, wherein on at least one side the washing element holder is closed off relative to the outside with the sponge material and the washing element comprises at least one synthetic surfactant as a foaming substance and as the principal constituent thereof, the washing element being in direct contact with the sponge material, wherein only contact with air and water causes the washing element to foam such the washing element foams without an external friction force being applied to the washing element.

* * * * *